United States Patent [19]

Denning

[11] 4,332,089

[45] * Jun. 1, 1982

[54] VARIABLE INDEXING PEGS

[76] Inventor: LeRoy M. Denning, 5925 Creekview Dr., Clarence Center, N.Y. 14032

[ * ] Notice: The portion of the term of this patent subsequent to Feb. 19, 1997, has been disclaimed.

[21] Appl. No.: 121,986

[22] Filed: Feb. 15, 1980

Related U.S. Application Data

[63] Continuation-in-part of Ser. No. 888,465, Jun. 21, 1977, Pat. No. 4,188,728.

[51] Int. Cl.[3] ..... B41B 1/00

[52] U.S. Cl. ..... 33/184.5

[58] Field of Search ..... 33/184.5

[56] References Cited

U.S. PATENT DOCUMENTS

| | | | |
|---|---|---|---|
| 2,692,433 | 10/1954 | Perna | 33/184.5 |
| 2,983,049 | 5/1961 | Andrisani | 33/184.5 |
| 3,695,760 | 10/1972 | Orr | 33/184.5 |
| 4,188,728 | 2/1980 | Denning | 33/184.5 |

*Primary Examiner*—Willis Little

*Attorney, Agent, or Firm*—William J. Crossetta, Jr.

[57] ABSTRACT

A method and apparatus for accurately and variably positioning carrier indexing pins in indexing pegs for indexed registering devices useful in positioning an image, mask or transparency in a step and repeat type printing process.

12 Claims, 22 Drawing Figures

VARIABLE INDEXING PEGS

This application is a continuation-in-part of U.S. application Ser. No. 888,465 filed June 21, 1977 now U.S. Pat. No. 4,188,728 issued Feb. 19, 1980.

BACKGROUND OF THE INVENTION

In the graphic arts industry where rows and columns of images are to be prepared on a positive and/or negative image producing transparency, by stepping the image from position to position, a problem has been the cost and inconvenience of obtaining accurate indexing pegs useful in the registering process.

Briefly, the aforesaid registering process is one wherein a registering device, being essentially a templet having opposing parallel margins to which masks, transparencies, or images may be attached, and having marginal rows of indexed registering holes which are regularly and accurately spaced on opposing parallel margins, into which may be securely placed indexing pegs having carrier pins located so as to correspond to the distances between adjacent images in a row and between rows of images, said indexing pegs being adaptable to index a mask, image or transparency in increments of distance which may be less than the distance between indexed register holes in the registering device. With the indexing pegs in position, an image carrier or mask may be placed on the device by means of tabs or holes in said carrier or mask which mate with the upper carrier pin of the indexing peg. The indexing peg is then attached to the registering device, said peg being adapted to mate precisely with the indexed registering holes of the registering device by means of anchor register pins so that the device is prepared for step and repeat type printing along a registering strip having equally spaced register holes corresponding to the position of the anchor registering pins in the indexing peg. The image, mask or transparency may be stepped from position to position in rows along the indexed, register margin in the step and repeat type printing process to form rows of adjacent like images. U.S. Pat. No. 2,983,049 issued May 9, 1961, describes a typical registering device with indexing pegs to which the instant invention pertains.

SUMMARY OF THE INVENTION

The instant invention relates to a method and apparatus for the accurate preparation of indexing pegs.

A better understanding of the invention of the present application may be had from a reading of the following specification and inspection of the drawings as follows. In FIGS. 1–10, indexing pegs of the prior art are shown which are adopted to be placed in the holes of a registering device at positions corresponding to selected distances for preparation of a transparency, mask or image carrier for use in a step and repeat type printing process.

DETAILED DESCRIPTION OF THE DRAWINGS

Figure 1:
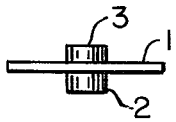
FIG. 1 PRIOR ART
FIGS. 1,3,5,7 and 9 show side views of various indexing pegs of the prior art.
Figure 2:
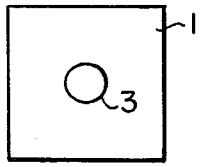
FIG. 2 PRIOR ART
FIGS. 2,4,6,8, and 10 show topographical view of various indexing pegs of the prior art according to FIGS. 1,3,5,7, and 9, respectively.
Figure 3:
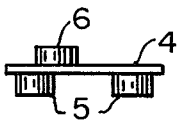
FIG. 3 PRIOR ART
Figure 4:
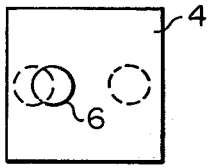
FIG. 4 PRIOR ART
Figure 5:
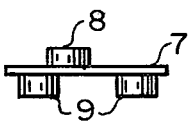
FIG. 5 PRIOR ART
Figure 6:
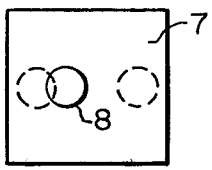
FIG. 6 PRIOR ART
Figure 7:
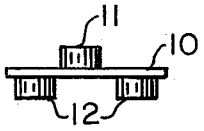
FIG. 7 PRIOR ART
Figure 8:
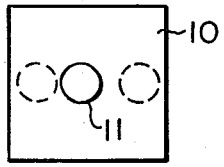
FIG. 8 PRIOR ART

The indexing peg of FIGS. 1 and 2 includes a pin plate 1 to which is attached a lower anchor pin 2 for engaging in an indexing hole in the registering device, and an upper carrier pin 3 actually aligned with the lower pin for engaging an image or mask carrier. Indexing pegs of the type indicated in FIGS. 1 and 2 may be used in registering devices where the distance between images or rows of images falls in the exact location of one of the holes provided in the registering device, but are inappropriate for use when the distance between images or rows of images falls at increments other than those inherent in the registering device.

The indexing pegs of FIGS. 3–10 are especially designed for distances other than those which follow the location of the holes of the registering device. For example, the indexing peg of FIGS. 3 and 4 includes a pin plate 4 having a pair of lower anchor pins 5 which are spaced apart by a distance equal to or in multiples of the distance of adjacent holes of the registering device. Also attached to the pin plate 4 is an upper carrier pin 6 which is offset by a predetermined distance between pins 5. In like fashion, but by a different predetermined offset distance in each instance, the indexing peg of FIGS. 5 and 6 includes a pin plate 7 to which an offset carrier pin 8 and a pair of anchor pins 9 are attached; the indexing peg of FIGS. 7 and 8 includes a pin plate 10 to which an offset carrier pin 11 and a pair of anchor pins 12 are attached; and the indexing peg of FIGS. 9 and 10 includes a pin plate 13 to which an offset carrier pin 14 and a pair of anchor pins 15 are attached.

Figure 9:
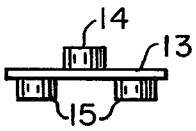
FIG. 9 PRIOR ART
Figure 10:
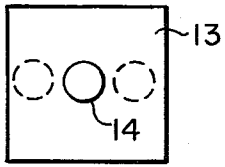
FIG. 10 PRIOR ART

The indexing peg of FIGS. 1–2 may be used when the selected distance falls at one of the indexing holes of the registering device; the indexing peg of FIGS. 9–10 is used where the selected distance falls halfway between adjacent holes; and the indexing pegs of FIGS. 3–8 provide for other distances. It should be noted that each of the indexing pegs of FIGS. 3–8 may be used without modification for two separate distances by merely turning the peg 180°.

In typical embodiments, spacing between the center of the indexing holes of the registering device itself is normally $\frac{1}{2}''$ with the holes being $\frac{1}{4}''$ in diameter, leaving $\frac{1}{4}''$ of solid material between each pair of adjacent holes. With such spacing of holes, the indexing pegs may each include $\frac{1}{4}''$ lower anchor pins, which in the case of pairs of pins on the offset pegs may be likewise spaced by $\frac{1}{2}''$ between centers and preferably 1" or longer, while the carrier pin 6 of the indexing peg of FIGS. 3–4 may be offset by 1/16"; the carrier pin 8 of the indexing peg of FIGS. 5–6 may be offset by $\frac{1}{8}''$; the carrier pin 11 of the indexing peg of FIGS. 7–8 may be offset by 3/16"; and the carrier pin 14 of the indexing peg of FIGS. 9–10 may be offset by $\frac{1}{4}''$. Thus, for the use of correct ones of the indexing pegs of FIGS. 3–10, a carrier pin may be provided which is located from an anchor pin in the registering device by any desired distance in accurate increments. In practice, a 1/64" increment has been found to be sufficiently small for the vast majority of cases. However, it will be appreciated that additional offset pegs may be provided for smaller increments of distance if required, and in any unit of measurement. It will also be appreciated that alignment of the anchor pins of the indexing peg need not be with adjacent registering holes of the registering device but may be in alignment with every other hole, third hole, fourth hole, or the like thereof. Such alignment may be desirable when the increment between carrier pin and anchor pin attachment of an adjacent hole arrangement is such as to unduly complicate or preclude pin attachment.

Figure 11:
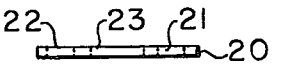
FIGS. 11,13,15, and 17 show side views of various indexing pegs of the instant invention.
Figure 12:
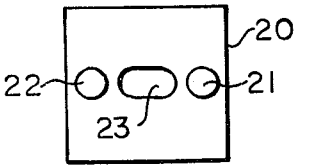
FIGS. 12,14,16, and 18 show topographical view of various indexing pegs of the instant invention according to FIGS. 11,13,15, and 17, respectively.

The instant invention relates to a method and apparatus for the preparation of the aforesaid indexing pegs, which allows convenient and inexpensive construction of indexing pegs, by an operator of the step and repeat type printing process. Such apparatus and process precludes the necessity of maintaining large numbers of varying offset indexing pegs and the concomitant expense and bother thereof. In accord herewith, FIGS. 11 and 12 represent an indexing peg having a pin plate 20 provided with anchor registering holes 21 and 22 and variable offset carrier pin hole 23. The pin plate may be inexpensively and easily manufactured with accurately placed anchor registering and variable offset holes for ready availability to the step and repeat printing process operator. The size and shape of the anchor registering hole is such as to accept pins of proper size and shape for the registering device being utilized and need not be the same size as the carrier pin. The distance between said anchor holes may be any convenient distance, but must be such distance which will allow both anchor registering pins to be accurately and securely placed in corresponding adjacent or other holes of the registering device. The anchor registering pins may be attached by any convenient method including mechanical means such as riveting, press fitting, screw fitting and the like, welding, adhesive means and the like and alternately, may be an integrally molded part of the pin plate, such that the pin plate and pins are a continuous material. The variable offset carrier pin hole must be of sufficient width and length so as to securely accept the desired offset carrier pin along its entire length, such that said carrier pin can be inserted in said variable carrier pin hole accurately and securely at any desired offset or other distance between the anchor registering pin holes. Alternately said variable carrier pin hole may be any convenient means which allows accurate and secure attachment of the carrier pin along the length of the pin plate, such as one or more channels or grooves and the like.

Figure 15:
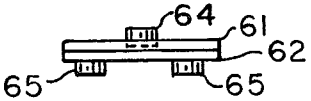
Figure 16:
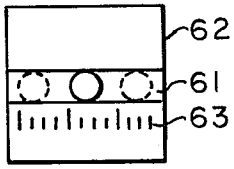

FIGS. 15 and 16 represent a variable offset indexing peg having as an integral part thereof a variable carrier pin channel 61. An increment scale allows the operator to pre-set the desired offset increment without reverting to added equipment. In this configuration pin plate 62 is provided with an increment scale 63, carrier pin 64, which is permanently or removably attached, and anchor register pins 65. Movement of carrier pin 64 through the variable carrier pin channel 61 of pin plate 62, to a point on increment scale 63 enables the operator to select increments corresponding to pre-established points in the increment scale. It should be understood that the invention contemplates placement of the groove, channel, slot, hole or otherwise at positions other than the center of the pin plate.

It should be understood that though in the previous disclosure, the carrier pin of FIGS. 15–16 are shown as a direct integral attachment to the register pin plate, the instant invention also contemplates the attachment of the carrier pin to a separate carrier pin plate which in turn is movably attached to the anchor register pin plate.

Figure 17:
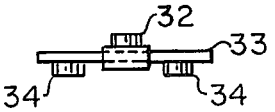
Figure 18:
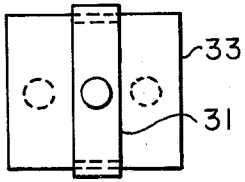

FIGS. 17 and 18 represent a variable offset indexing peg having as an integral part thereof a separate carrier pin plate sliding means 31, having a carrier pin 32 attached or integrally molded to the carrier pin plate sliding means allowing adjustment of the carrier pin along the length of the anchor register pin plate 33 which in turn is secured at the registering device through registering pins 34. In such configuration the carrier pin plate sliding means may additionally contain a groove, channel, slot or the like, allowing adjustment of the carrier pin along the depth of the sliding means, and consequently the width of the pin plate, to facilitate handling of the workpiece.

Figure 19:
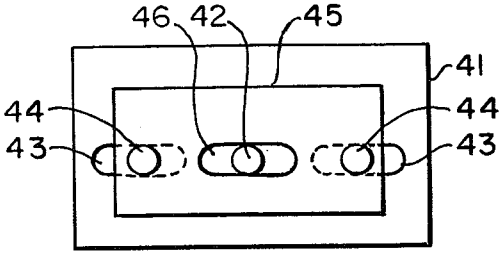
FIGS. 19 and 20 respectively show topographical and side views of another embodiment of the instant invention.
Figure 20:
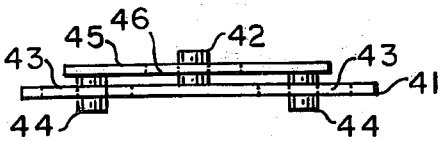

FIGS. 19 and 20 represent a variable offset indexing peg with a variable carrier pin sliding means 41, having a carrier pin 42 attached or integrally molded to the sliding means and having register pin slots 43. The registering pins are attached to anchor register pin plate 45 having a carrier pin slot 46 therein. Lateral movement of either plate will allow variable displacement of the carrier pin relative to the anchor register pins and either plate may contain increment scales for accurate placement of the carrier pin.

Figure 21:
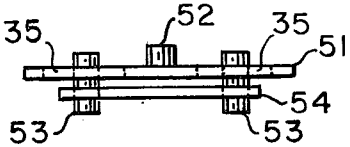
FIGS. 21 and 22 respectively show side and topographical views of and indexing peg defining a further embodiment of the instant invention.
Figure 22:
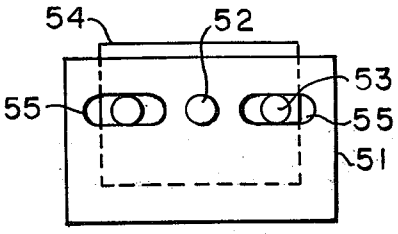

FIGS. 21 and 22 represent a variable offset indexing peg having a variable carrier sliding pin means 51, with carrier pin 52 attached or integrally molded thereto and having anchor register pins 53 attached to register pin plate 54. Variable carrier sliding pin 51 has slots 55 therein which allow variable displacement of the carrier pin relative to the register pins and either plate may contain incremental scales for accurate placement of the carrier pin.

Figure 13:
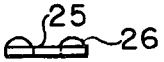
Figure 14:
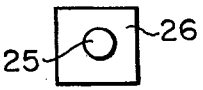

Attachment of such variable carrier pins may be achieved by any convenient method including mechanical means such as riveting, press fitting, screw fitting integral molding and the like and may be slidably, movably or removably attached depending upon the specific apparatus contemplated. An especially convenient method is a removable adhesive mounting such as can be achieved by utilizing the attachment mark of FIGS. 13 and 14 having a carrier pin hole 25, corresponding in size and shape to the carrier pin utilized, which attachment mark has pressure sensitive adhesive 26 on the attachment side thereof, thereby allowing it to secure the variable carrier pin at any desirable offset or equal position within the variable offset carrier pin hole groove or channel of the indexing peg. It should be understood that the attachment mark may have only a portion of the attachment side containing adhesive and also may not have adhesive thereon but be attachable by utilizing separate attaching means.

The indexing pegs of this invention may be made of any suitable material. Typically, the pin plate is made of a flexible but resilient material such as a suitable plastic, cellulosic, coated cellulosic, layered or metallic material. A preferred material is a resilient plastic. The anchor pins and carrier pins may also be made of any suitable material such as plastic or metal, the preferred materials being brass, aluminum, stainless steel or plastic. Where appropriate, the pins may be a continuous molding of the carrier pin plate or anchor registering pin plate.

The method useful for accurately establishing a variable offset pin position within the variable offset carrier pin hole comprises the steps of establishing the distance between permanent registering holes on the indexing peg such as to correspond with selected indexing holes of the registering device, and thereafter attaching the variable offset carrier pin at a point within the variable offset carrier pin hole corresponding to the desired distance between registering holes. Typical apparatuses which may be used to accurately obtain desired offset distances include increment scales, templets or slide adjusting mechanisms.

The advantages of the process and apparatus of the instant invention are not solely derived from the provision of presettable registering pin. As constructed, the registering pegs are useful devices for layout and alignment work wherein there is required a high degree of accuracy and consistency with ease and convenience to the operator.

I claim:

1. A method for accurately and variably positioning an indexing carrier pin in an indexing peg for indexed registering devices comprising forming a variable indexing peg having an anchor registering pin plate with anchor registering pins thereon corresponding in size, shape and distance therebetween to selected holes of an indexed registering device, providing a means for attachment of an indexing carrier pin at variable positions along the length of said plate and attaching said carrier pin at a point along the length of said plate.

2. The method of claim 1 wherein said anchor registering pins are an integrally molded part of the anchor registering pin plate.

3. The method of claim 2 wherein said means for attachment of the carrier pin is a slotted opening in said anchor registering pin plate.

4. The method of claim 1 wherein said carrier pin attachment means is selected from a groove or channel means and said carrier pin is movably attached thereto.

5. The method of claim 1 wherein said carrier pin is attached to a carrier pin plate which is movably attached to the anchor register pin plate.

6. A variable indexing peg for an indexed registering device comprising an anchor registering pin plate with anchor registering pins thereon corresponding in size, shape and distance therebetween to selected indexing holes of said indexed registering device, means for attachment of an indexing carrier pin at variable positions along the length of said plate and a carrier pin movably attached to said registering pin plate.

7. The variable indexing peg of claim 6 wherein said means for attachment is selected from slot, groove or channel means and said carrier pin is movably attached thereto.

8. The variable indexing peg of claim 6 wherein said anchor registering pins are an integrally molded part of the anchor registering pin plate.

9. The variable indexing peg of claim 6 wherein said carrier pin is attached to a carrier pin plate which is movably attached to the anchor register pin plate.

10. The variable indexing peg of claim 9 wherein said carrier pin plate is attached to the anchor register pin plate by means selected from groove, channel or slot means.

11. The variable indexing peg of claim 9 wherein said carrier pin is attached to said carrier pin plate by means selected from groove, channel or slot means.

12. The variable indexing peg of claim 9 wherein said carrier pin is an integrally molded part of the carrier pin plate.

* * * * *